US005608175A

United States Patent [19]

Kawamura

[11] Patent Number: 5,608,175

[45] Date of Patent: Mar. 4, 1997

[54] KEYBOARD MUSICAL INSTRUMENT HAVING REGULABLE REGULATING BUTTONS LINKED WITH HAMMER STOPPER

[75] Inventor: Kiyoshi Kawamura, Hamamatsu, Japan

[73] Assignee: Yamaha Corporation, Japan

[21] Appl. No.: 343,370

[22] Filed: Nov. 22, 1994

[30] Foreign Application Priority Data

Nov. 30, 1993 [JP] Japan ..... 5-068463 U

[51] Int. Cl.[6] ..... G10D 15/00

[52] U.S. Cl. ..... 84/171; 84/243; 84/236

[58] Field of Search ..... 84/170, 171, 172, 84/216, 21, 23, 33, 243, 236

[56] References Cited

U.S. PATENT DOCUMENTS 5,374,775 12/1994 Kawamura et al. ..... 84/171

*Primary Examiner*—Cassandra C. Spyrou
*Attorney, Agent, or Firm*—Graham & James LLP

[57] ABSTRACT

A keyboard musical instrument has an acoustic piano, an electronic sound generating system, a rotary stopper for preventing sets of strings from impacts of hammer heads and regulator for changing distances between regulating buttons and toes of jacks, and a link mechanism connects a pedal and both of the rotary stopper and the regulator so as to concurrently change the rotary stopper and the regulator between an acoustic sound mode and a silent mode.

7 Claims, 7 Drawing Sheets

KEYBOARD MUSICAL INSTRUMENT HAVING REGULABLE REGULATING BUTTONS LINKED WITH HAMMER STOPPER

FIELD OF THE INVENTION

This invention relates to a keyboard musical instrument and, more particularly, to a keyboard musical instrument performable with or without acoustic sounds.

DESCRIPTION OF THE RELATED ARTS

An acoustic piano known as an upright piano or a grand piano is equipped with pedal mechanisms for changing the impression of sound on the ear, and one of the pedal mechanisms is called as a soft pedal mechanism. Although the soft pedal mechanism is different in construction between the upright piano and the grand piano, both of the soft pedal mechanisms lessen the volume of sounds during actuation by the player.

The soft pedal mechanism incorporated in the upright piano either slightly pushes a hammer rail toward strings for decreasing distances between the hammer heads and the strings or moves a hammer felt between the hammer heads and the strings. In either way, the hammer softly strikes the associated set of strings, and lessens the volume.

On the other hand, the soft pedal mechanism incorporated in the grand piano laterally moves the key bed so as to slightly offset the hammer assemblies with respect to the sets of strings. The hammer head starts the rotation from the offset position toward the sets of strings, and strikes a fewer number of strings. As a result, the volume of sound is decreased.

Thus, while the player is actuating the soft pedal mechanism, the volume of sound are decreased, and the player changes the impression of sound or sounds. However, the soft pedal mechanism can not perfectly make the acoustic piano silent in spite of fingering on the keyboard.

In order to prevent the sets of strings from the hammer heads, U.S. Pat. No. 2,250,065 discloses a silent mechanism incorporated in an acoustic piano. According to the U.S. Patent, the silent mechanism pulls up the hammer assemblies, and, accordingly, the hammer butts are spaced from the associated jacks. In this situation, even if a player depresses a key for driving the jack, the rotation of the jack is not transferred to the hammer butt, and the hammer is never driven for rotation. As a result, while the player is fingering on the keyboard, only the key action mechanisms are actuated without transferring the motions to the hammer assemblies, and the silent mechanism keeps the sets of strings silent.

The key switches and the controller are incorporated in the keyboard musical instrument disclosed in the U.S. Patent, and produce electric sounds instead of the acoustic piano sounds. However, the prior art keyboard musical instrument hardly satisfies a player, because the key touch is too light due to the separation between the jacks and the hammer butts.

The present inventor proposes a shank stopper in U.S. Ser. No. 08/073,092, and the shank stopper causes the hammers to rebound thereon after the escape of the jacks. Therefore, the player can practice the fingering on the keyboard without acoustic sounds, and the key touch is close to that of a standard piano.

U.S. Ser. No. 08/073,092 further discloses regulating buttons changed by a solenoid-operated actuator. When the regulating buttons become closer to the associated jacks, the jacks escape from the associated butts earlier than the regulating buttons at the standard positions, and allow the jacks to surely escape from the hammer butts before the hammer shanks rebound on the shank stopper. The key touch is almost same as that of a standard piano, and the player can practice fingerings in the same key-touch as the standard piano.

However, a problem is encountered in the keyboard musical instrument previously proposed by the present inventor in that the keyboard musical instrument requires the player to change both of the stopper and the regulating buttons. If the player forgets to change the regulating buttons to the closer position, the player practices the fingerings on the keyboard in a close but different key-touch. The trifle difference in the key-touch may not be a problem for a beginner. However, a senior player is expected to strictly control his or her fingers for expressing a music, and the trifle difference disturbs his finger control.

SUMMARY OF THE INVENTION

It is therefore an important object of the present invention to provide a keyboard musical instrument which keeps a key-touch in both silent and electronic sound modes regardless of player's carefulness.

To accomplish the object, the present invention proposes to link a stopper mechanism with a regulating mechanism.

In accordance with the present invention, there is provided a keyboard musical instrument having at least an acoustic sound mode for producing acoustic sounds and an electronic sound mode for producing electronic sounds, comprising: a) an acoustic piano having a-1) a keyboard implemented by a plurality of swingable keys depressed by a player in both acoustic sound and electronic sound modes, notes of a scale being assigned to the plurality of swingable keys, respectively, a-2) a plurality of key action mechanisms functionally connected to the plurality of swingable keys, respectively, and selectively actuated by depressed keys of the keyboard in both acoustic sound and electronic sound modes, a-3) a plurality of hammer assemblies respectively associated with the plurality of key action mechanisms, and selectively driven by actuated key action mechanisms functionally connected to the depressed keys from respective home positions thereof in both acoustic sound and electronic sound modes, each of the actuated key action mechanisms and the associated hammer assembly producing a piano-touch in both acoustic sound and electronic sound modes at an escape of the key action mechanism, a-4) a plurality of regulating buttons respectively associated with the plurality of key action mechanisms, the actuated key action mechanisms being brought into contact with the associated regulating buttons so as to escape from the associated hammer assemblies, and a-5) a plurality of string means respectively associated with the plurality of hammer assemblies, and selectively struck by hammer assemblies driven by the actuated key action mechanisms in the acoustic sound mode for producing the acoustic sounds; b) an electronic sound generating system for producing the electronic sounds having notes identified by the depressed keys in the electronic sound mode; and c) a mode controlling system having c-1) stopper changed between a free position in the acoustic sound mode and a blocking position in the electronic sound mode, the stopper in the free position allowing the hammer assemblies associated with the actuated key action mechanisms to strike the associated string means, the stopper in the blocking position causing the hammer assemblies associated with the actuated key action mechanisms to return to the home positions between the escapes and strikes at the associated string means, c-2) a regulator functionally connected to the plurality of regulating buttons, and changing distances between the plurality of key action mechanisms and the plurality of regulating buttons between the acoustic sound mode and the electronic sound mode for allowing the plurality of key action mechanisms to escape in both acoustic sound and electronic sound modes, and c-3) a link means connected between the stopper and the regulator, and concurrently causing the stopper and the regulator to change the position between the free position and the blocking position and the distances between the plurality of key action mechanisms and the plurality of regulating buttons, respectively.

BRIEF DESCRIPTION OF THE DRAWINGS

The feature and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
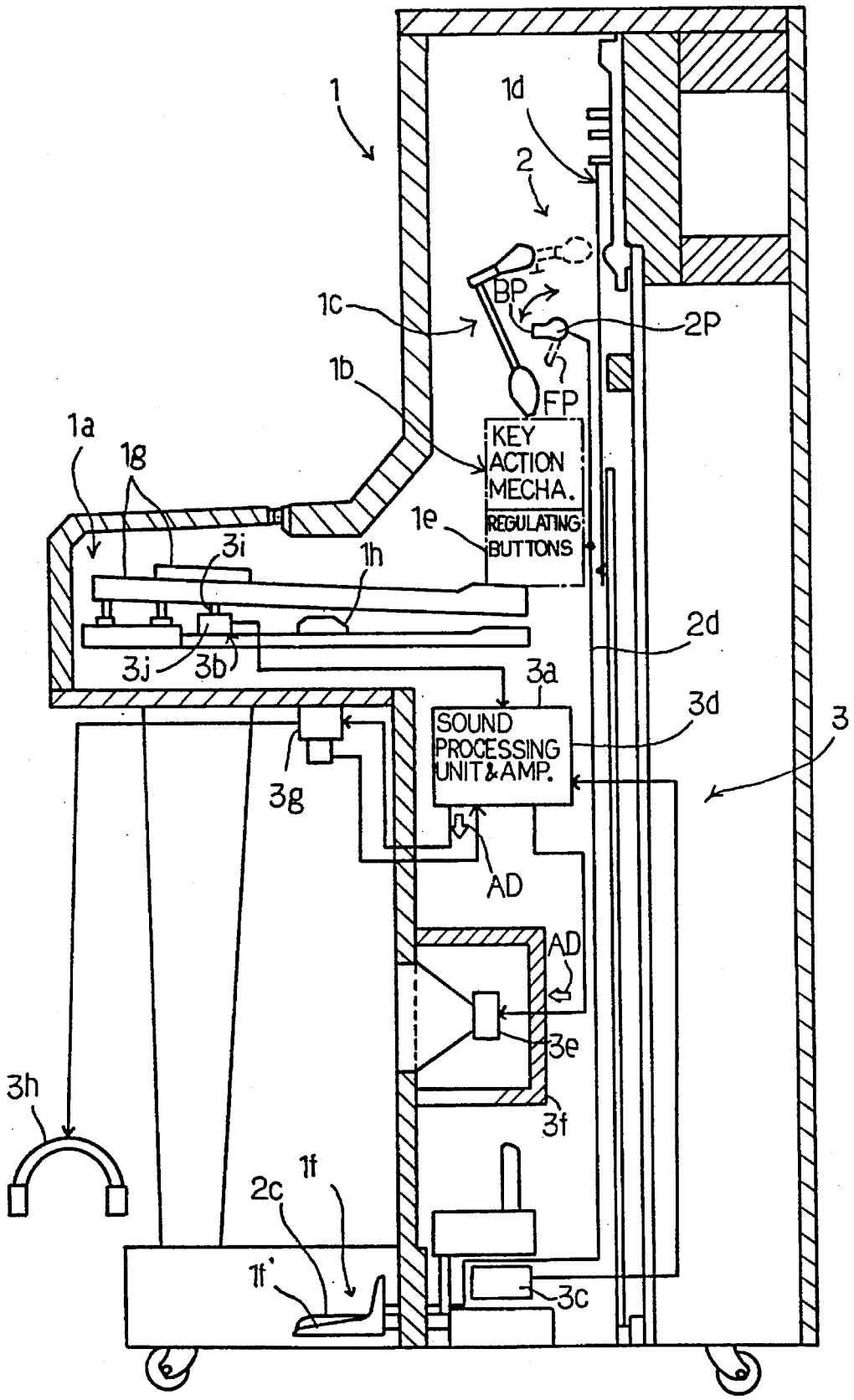
FIG. 1 is a schematic view showing a keyboard musical instrument according to the present invention.

Referring first to FIG. 1 of the drawings, a keyboard musical instrument embodying the present invention largely comprises an acoustic piano 1, a controlling system 2 and an electronic sound generating system 3, and has at least an acoustic sound mode and a silent mode.

While the keyboard musical instrument is staying in the acoustic sound mode, the keyboard musical instrument serves as a standard acoustic upright piano, and the sounds and the key-touch are identical with those of the acoustic upright piano. On the other hand, when the keyboard musical instrument is changed to the silent mode, the electronic sound generating system 3 generates music tone signals in response to the fingering, and electronic sounds are produced therefrom as will be described hereinlater. The electronic sound generating system 3 may be silent in the silent mode by manipulating a switch or pulling out a jack of a headphone from a socket. The keyboard musical instrument may have a recording mode, a playback mode and an ensemble mode. The electronic sound generating system 3 records a performance in a suitable memory in the recording mode, and reproduces the performance in the playback mode. In the ensemble mode, a player enjoys an ensemble with the electronic sound generating system 3, and both of the acoustic piano 1 and the electronic sound generating system 6 produce the acoustic sounds and the electronic sounds.

In this instance, the acoustic piano 4 is of the upright type. However, a grand piano is available for the keyboard musical instrument.

The acoustic piano 1 comprises a keyboard 1*a*, a plurality of key action mechanisms 1*b*, a plurality of hammer mechanisms 1*c*, a plurality of sets of strings 1*d*, regulating buttons 1*e* and a pedal mechanism 1*f*. The keyboard 1*a* is mounted on a key bed, and is implemented by black and white keys 1*g*. The black and white keys 1*g* are turnable with respect to balance pins embedded in a balance rail 1*h*.

The key action mechanisms 1*b* are functionally connected to the rear ends of the black and white keys 1*g*, respectively, and drive the hammer mechanisms 1*c* for rotations toward the sets of strings 1*d*. Each of the regulating buttons 1*e* determines an escaping timing for the associated key action mechanism 1*b*, and the hammer mechanism 1*c* rushes toward the associated set of strings 1*d* after the escape. Thus, the key action mechanisms 1*b* and the regulating buttons 1*e* convert upward motions of the black and white keys 1*g* to rotations of the associated hammer assemblies 1*c*, and give unique piano key touch to a player in cooperation with the hammer assemblies 1*c*.

Figure 2:
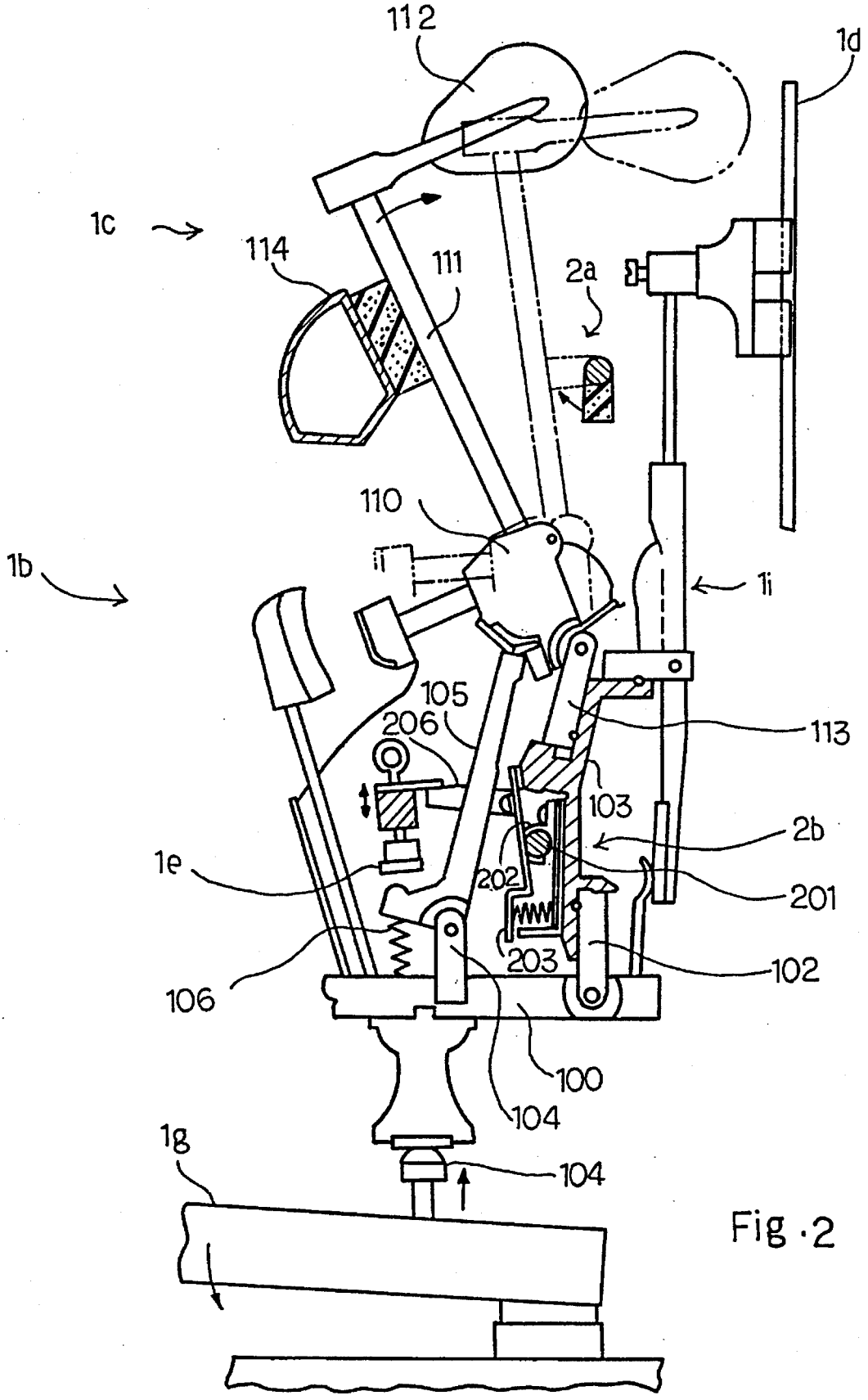
FIG. 2 is a side view showing the arrangement of a key action mechanism, a hammer assembly and a regulating button incorporated in the keyboard musical instrument.

The key action mechanisms 1*b* are similar in structure to one another, and each key action mechanism 1*b*, the associated hammer assembly 1*c* and the associated regulating button 1*e* are illustrated in detail in FIG. 2.

The key action mechanism 1*b* comprises a whippen assembly 100 in contact with a capstan button 101 implanted into a rear end portion of the associated key 1*g* and a whippen flange 102 fixed to a center rail 103, and the whippen assembly 100 is swingably supported through the whippen flange 102 by the center rail 103. While the capstan button 1401 is pushing up the whippen assembly 100, the whippen assembly 100 rotates around the whippen flange 102 in the clockwise direction.

The key action mechanism 1*b* further comprises a jack flange 104 fixed to the whippen assembly 100 and projecting upwardly, a jack 105 swingably supported by the jack flange 104 and a jack spring 106 provided between the whippen assembly 100 and the toe of the jack 105, and the regulating button 1*e* is spaced from the toe of the jack 404 before the capstan button 101 pushes up the whippen assembly 100.

The jack 105 is held in contact with the associated hammer assembly 1*c* when the key 1*g* is in the rest position. While the whippen assembly 100 is rotating around the whippen flange 102 in the clockwise direction, the whippen assembly 100 presses the jack spring 106 against the jack 105. However, the hammer assembly 1*c* restricts the jack 105, and the jack spring 106 is compressed between the whippen assembly 100 and the jack 105 during the rotation of the whippen assembly 100. When the toe of the jack 105 is brought into contact with the regulating button 1*e*, the jack spring 106 urges the jack 105 to escape from the hammer assembly 1*c*, and the hammer assembly 1*c* is driven for rotation in the clockwise direction toward the set of strings 1*d*.

The hammer assembly 1*c* comprises a hammer butt 110 engaged with the jack 105, a hammer shank 111 implanted into the hammer butt 110 and a hammer head 112 connected to the leading end of the hammer shank 111, and the hammer butt 110 is rotatably supported by a butt flange 113 fixed to the center rail 103. While the associated key 1*g* is remaining in the rest position, the hammer shank 111 is in contact with a hammer rail 114, and the position in contact with the hammer rail 114 is a home position of the hammer assembly 1*c*.

When the jack 105 escapes from the hammer assembly 1*c*, the jack 105 imparts kinetic energy to the hammer assembly 1*c*, and the hammer assembly 1*c* rotates toward the associated set of strings 1*d*.

Although a plurality of damper mechanisms 1*i* are further incorporated in the acoustic piano 1, description is omitted, because the damper mechanisms 1*i* are less important to understand the present invention.

Turning back to FIG. 1 of the drawings, the pedal mechanism 1*f* have at least two pedals 1*f'* and respective link sub-mechanisms. One of the two pedals 1*f'* is called as a damper pedal, and allows the strings 1*d* to prolong the vibrations. The other pedal 1*f'* is called as a soft pedal, and causes the hammer heads 112 to softly strike the associated strings 1*d* for lessening the volume.

The controlling system 2 comprises a rotary stopper 2*a*, a regulator 2*b* for changing gaps between the jacks 105 and the regulating buttons 1*e*, a pedal 2*c* provided between the damper and sot pedals 1*f'* and a link mechanism 2*d* connected between the pedal 2*c* and the rotary stopper 2*a*/the regulator 2*b*.

The rotary stopper 2*a* is located between the sets of strings 1*d* and the hammer assemblies 1*c*, and is faced to the hammer shanks 111. The rotary stopper 2*a* is changeable between a free position FP and a blocking position through the angular motion thereof. The rotary stopper 2*a* is staying at the free position in the acoustic sound mode, and allows the hammer heads 112 to rebound on the sets of strings 1*d*. As a result, the strings vibrate, and produce the acoustic sounds, respectively. On the other hand, the rotary stopper 2*a* enters into the blocking position in the silent mode, and the hammer shanks 111 rebound on the rotary stopper 2*a* before impacts at the strings 1*d*. Therefore, the strings 1*d* do not vibrate, and the acoustic sounds are not produced.

Figure 3A:
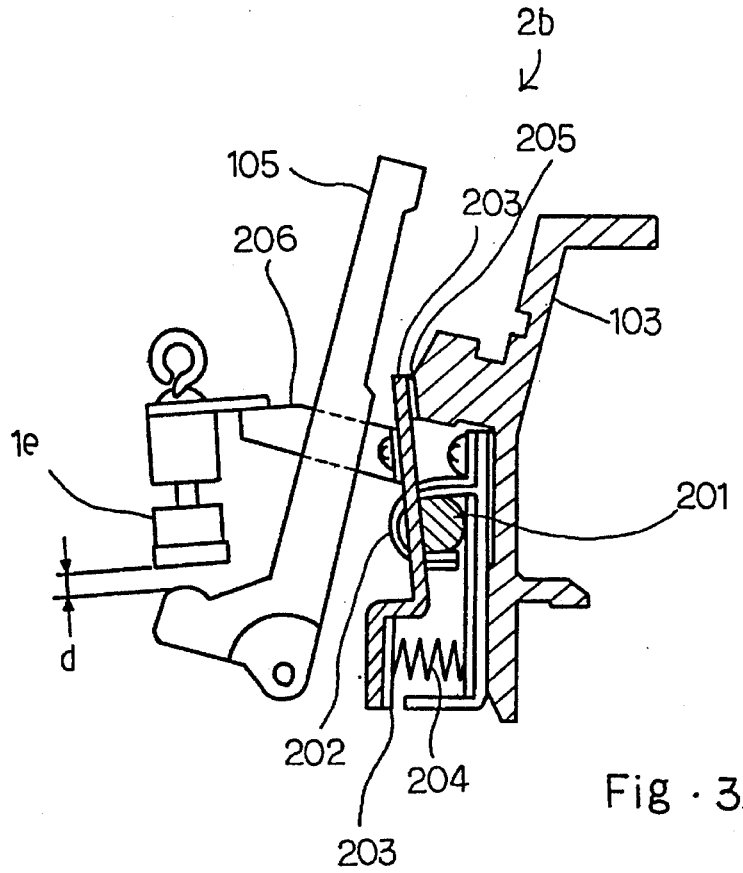
FIGS. 3A and 3B are side views showing a regulator for regulating buttons incorporated in the keyboard musical instrument.
Figure 3B:
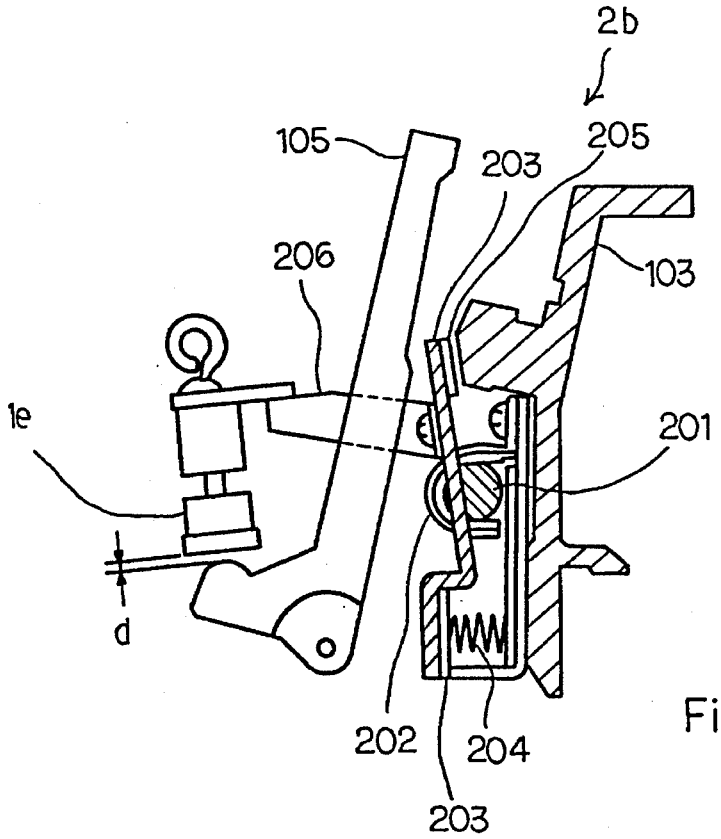

As will be better seen from FIGS. 3A and 3B of the drawings, the regulator 2*b* comprises a rod member 201 rotatably supported by bearing units 202 bolted to the center rail 103, a plurality of plate members 203 fixed to the rod member 201, return spring members 204 provided between the bearing units 202 and the plate members 203 for urging the plate members 203 to rotate in the clockwise direction, cushion sheets 205 attached to the plate members 203 and a plurality of arm members 206 projecting from the plate members 203 for supporting the regulating buttons 1*e*.

If the rod member 201 brings the cushion sheets 206 into contact with the center rail 103 as shown in FIG. 3A, the regulating buttons 1*e* enter into a spaced position, and the regulating buttons 1*e* are widely spaced from the associated jacks 105. A gap d between each regulating button 1*e* and the toe ranges from 3 millimeters to 5 millimeters, and the jack 105 escapes from the butt 110 at 2 to 3 millimeters between the hammer shank 111 and the associated set of strings 1*d*. The regulator 2*b* changes the regulating buttons 1*e* to the spaced position in the acoustic sound mode, and the gap d is approximately equal to the gap of a standard upright piano.

On the other hand, if the rod member 201 rotates in the counter clockwise direction, the cushion members 203 on the opposite side are brought into contact with the bearing units 202, and the regulating buttons 1*e* becomes closer to the jacks 105. The regulating buttons 1*e* enter into a close position, and the regulator 2*b* causes the regulating buttons 1*e* to enter into the close position in the silent mode. The gap d is decreased to 1 to 3 millimeters, and the jack 105 escapes from the butt 110 at 8 to 15 millimeters between the hammer shanks 111 and the strings 1*d*. Thus, the jacks 105 escape from the associated butts 110 earlier than the jack in the acoustic sound mode, and surely give the unique piano touch to the player without a strict regulation of the rotary stopper 2*a*.

Figure 4:
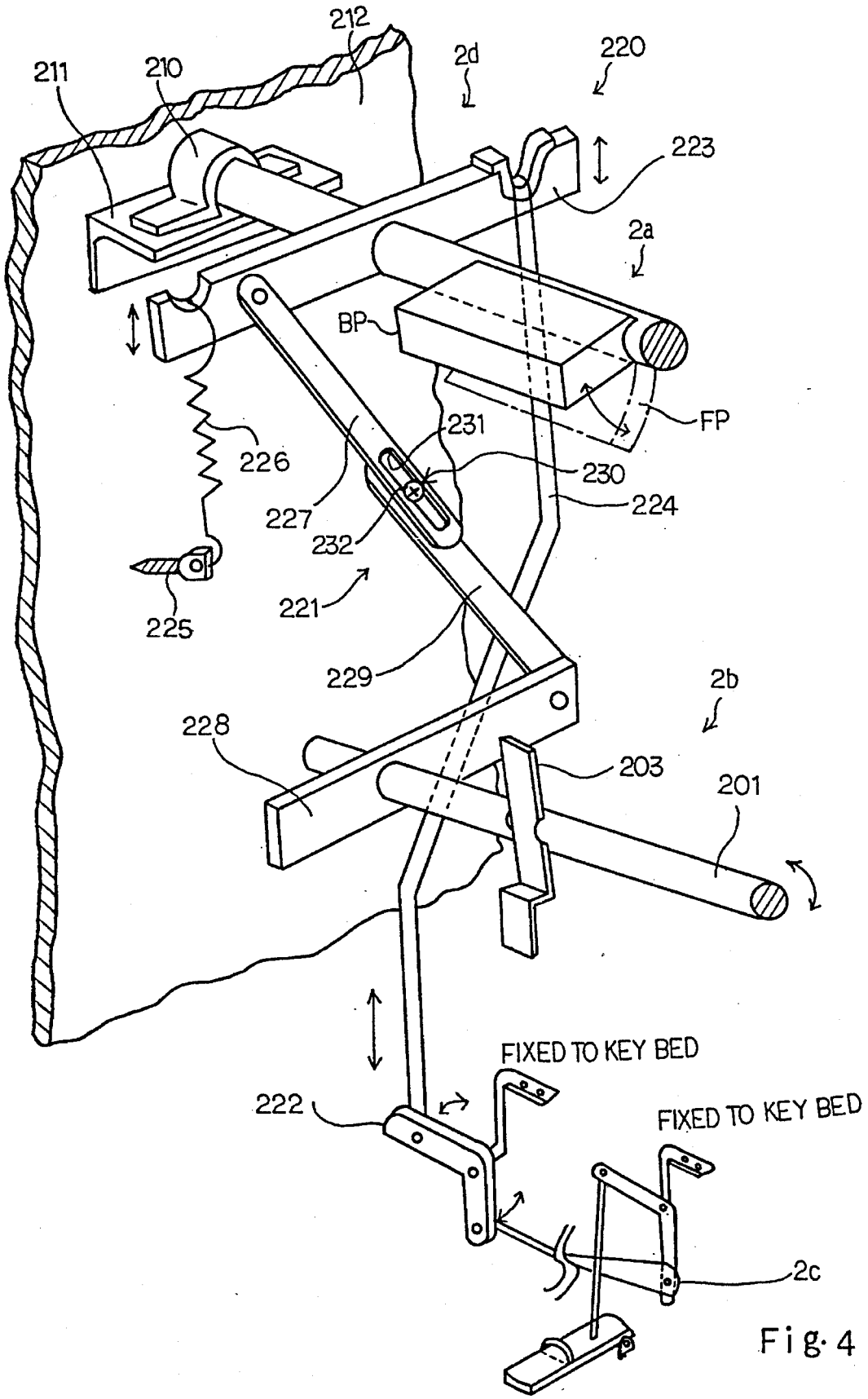
FIG. 4 is a perspective view showing a link mechanism connected between a rotary stopper/regulator and a pedal.

The link mechanism 2*d* is detailed in FIG. 4 of the drawings. As shown in the figure, the rotary stopper 2*a* is rotatably supported by bearing units 210, and the bearing units 210 is mounted on bracket members 211 screwed to side boards 212 of the acoustic piano 1. Action brackets of the acoustic piano are available for supporting the rotary stopper 2*a*.

The link mechanism 2*d* is broken down into a driving sub-mechanism 220 and an interlock sub-mechanism 221, the driving sub-mechanism 220 is provided between the pedal 2*c* and the rotary stopper 2*a*, and has an arm member 222 driven by the pedal 2*c*, an arm member 223 fixed to the rotary stopper 2*a*, a flexible cord 224 connected between the arm members 222 and 223, an anchor bolt 225 screwed into the side board 212 and a return spring 226 tensioned between the anchor bolt 225 and the arm member 223. The flexible cord 224 is implemented by a flexible tube and a flexible line passing through the flexible tube.

When a player steps on the pedal 2*c*, the arm member 222 pulls down the flexible cord 224, and the arm member 223 changes the rotary stopper 2*a* from the free position to the blocking position BP.

On the other hand, if the pedal is released, the return spring 226 rotates the rotary stopper 2*a* in the opposite direction, and the rotary stopper 2*a* is changed from the blocking position BP and the free position FP.

The interlock sub-mechanism 221 comprises a link member 227 pivotally connected to the arm member 223, an arm member 228 fixed to the rod member 201, a link member 229 pivotally connected to the arm member 228 and an adjuster 230 for regulating the free position FP and the spaced position. In this instance, the adjuster 230 is implemented by an elongated hole 231 formed in the link member 227 and a bolt 232 for pressing the link member 227 to the other link member 229.

Thus, the interlock sub-mechanism 221 causes the regulator 2*b* to change the regulating buttons 1*e* depending upon the position of the rotary stopper 2*a*. Therefore, a player always practices a fingering on the keyboard 1*a* in almost the same key-touch as the standard acoustic piano in the silent mode.

Turning back to FIG. 1 of the drawings, the electronic sound generating system 3 largely comprises a sound processing unit 3*a*, a plurality of key sensors 3*b* connected to the sound processing unit 3*a*, a pedal sensor 3*c* associated with the damper pedal 1*f'* and also connected to the sound processing unit 3*a*, an amplifier unit 3*d* associated with the sound processing unit 3*a*, a speaker system 3*e* housed in a speaker box 3*f* and connected to the amplifier unit 3*d*, a socket unit 3*g* also connected to the amplifier unit 3*d* and a headphone 3*h* detachable from the socket unit 3*g*. In this instance, the keyboard musical instrument is equipped with both of the speaker system 3*e* and the headphone 3*g*. However, only the headphone 3*h* may be incorporated in the electronic sound generating system 3 in another implementation.

The key sensors 3*b* are respectively associated with the plurality of black and white keys 1*g*, and each of the key sensors 3b comprises a shutter plate 3i fixed to the bottom surface of the associated key 1g and a photo-interrupter 3j for monitoring the motion of the shutter plate 3i. Four different slit patterns are formed in the shutter plate 3i, and the four slit patterns sequentially pass through an optical path produced by the photo interrupter 3j. The photo interrupter 3j produces a digital signal variable with the slit pattern passing through the optical path, and supplies the digital signal to the sound processing unit 3a. The sound processing unit 3a determines the key velocity and estimates the time when the associated hammer head 112 strikes the strings 1d.

The pedal sensor 3c monitors the damper pedal 1f' to see whether or not the player steps on it. If the player steps on the damper pedal 1f', the pedal sensor 3c detects the current position of the damper pedal 1f', and reports the current position to the sound processing unit 3a.

Figure 5:
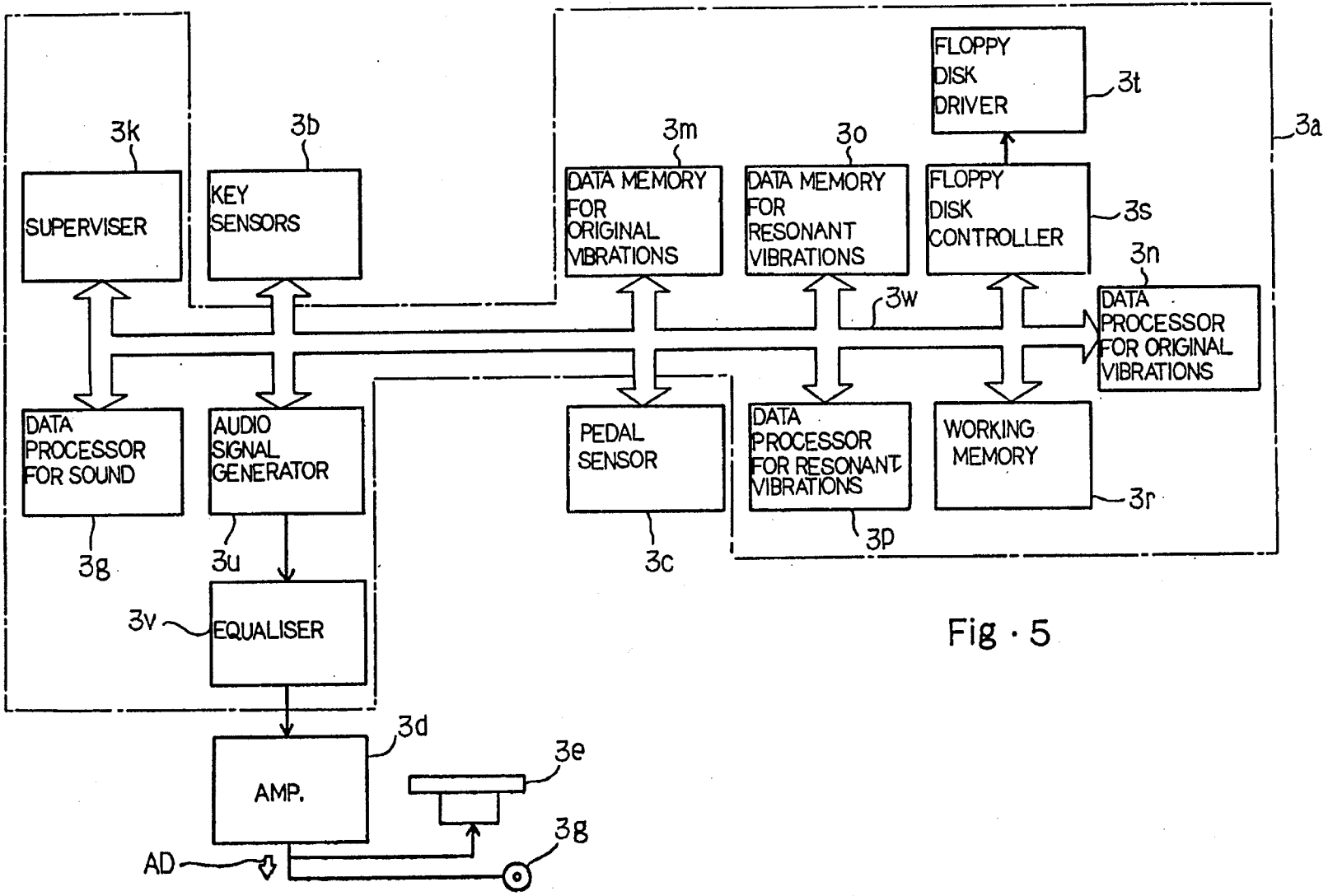
FIG. 5 is a block diagram showing the arrangement of an electronic sound generating system incorporated in the keyboard musical instrument.

The sound processing unit 3a is arranged as shown in FIG. 5 of the drawings, and comprises a supervisor 3k, a data memory 3m for original vibrations, a data processor 3n for original vibrations, a data memory 3o for resonant vibrations, a data processor 3p for resonant vibrations, a data processor 3q for sound spectrum, a working memory 3r, a floppy disk controller 3s, a floppy disk driver 3t, an audio signal generator 3u, an equalizer 3v and a bus system 3w. In this instance, the data memories 3m and 3o are implemented by non-volatile memory devices such as, for example, read only memory devices, and random access memory devices serve as the working memory 3r.

The supervisor 3k sequentially scans signal input ports assigned to the digital signals from the key sensors 3b and the detecting signal from the pedal sensor 3c, and supervises the other components 3m to 3u for producing an audio signal AD. An internal table is incorporated in the supervisor 3k, and the internal table defines relation between the key numbers, key velocity and timings for producing the audio signal. The audio signal AD is supplied from the equalizer 3v to the amplifier unit 3d, and the audio signal AD is thereafter distributed to the speaker system 3e and the socket unit 3g for producing electronic sounds.

The data memory 3m for original vibrations stores a plurality sets of pcm (Pulse Code Modulation) data codes indicative of frequency specular of original vibrations on the strings 1d, and each set of pcm data codes is corresponding to one of the keys 1g. A plurality groups of pcm data codes form a set of pcm data codes, and are corresponding to frequency specular at different intensities or hammer speeds. In general, if a hammer head 112 strongly strikes the associated string 1d, higher harmonics are emphasized. The plurality sets of pcm data codes are produced with a sampler (not shown) through sampling actual vibrations on the respective strings 1d at an appropriate frequency. The set of pcm data codes may be produced by means of the data processor 3q through a real-time manner. Using a group of pcm data codes, original vibrations produced upon depressing a key 1g are restored, and the supervisor 3k controls the sequential access to a group of pcm data codes stored in the data memory 3m.

The data processor 3n for original vibrations is provided in association with the data memory 3m, and modifies a group of pcm data codes for an intermediate hammer speed. The modification with the data processor 3n is also controlled by the supervisor 3k.

The data memory 3o for resonant vibrations stores a plurality sets of pcm data codes indicative of resonant vibrations, and the resonant vibrations take place under stepping on the damper pedal.

While a player steps on the damper pedal of an upright piano, dampers 1i are held off, and some of the strings 1d are resonant with the string struck by a hammer head 112. The resonant tones range −10 dB and −20 dB with respect to the tone originally produced through striking with the hammer head 112, and time delay of several millisecond to hundreds millisecond is introduced between the originally produced sound and the resonant tones. If the player continuously steps on the damper pedal 1f', the resonant tones continues several seconds. The player can rapidly terminate the original and resonant tones by releasing the damper pedal 1f'.

The electronic sound generating system 3 can impart the same effect to the electronic sounds, and the pcm data codes stored in the memory 3o are used for producing the resonant tones. Namely, the audio signal generator 3u is responsive to the detecting signal of the pedal sensor 3c, and the supervisor 3k allows the pcm data codes to be sequentially fetched by the data processor 3p. The pcm data codes stored in the data memory 3o are indicative of frequency specular of the resonant vibrations, and are also produced by means of the sampler or the data processor 3p for resonant vibrations. Each set of pcm data codes is corresponding to one of the depressed keys 1g, and is constituted by six groups of pcm data codes at the maximum. Each group of pcm data codes is corresponding to one of the resonant strings 1d, and the second harmonic to the sixth harmonic are taken into account for strings one octave higher than low-pitched sounds. However, if the depressed key 1g is lower than the thirteenth key from the lowest key in the eighty-eight key keyboard, the string one octave lower than the depressed key should be taken into account. In general, seventy-one damper mechanisms are incorporated in a piano. However, another piano may have sixty-six damper mechanisms or sixty-nine damper mechanisms. As described hereinbefore, the intensity of frequency spectrum is corresponding to the hammer speed, and the intensities are variable with the type and model of the piano.

A set of pcm data codes are sequentially read out from the data memory 3o depending upon the depressed key 1g under the control of the supervisor 3k, and the data processor 3p for resonant vibrations modifies the pcm data codes for an intermediate intensity. The memory capacity of the data memory 3o may be large enough to store the pcm data codes at all of the detectable hammer speeds, and the data processor 3p may calculate each set of pcm data codes on the basis of parameters stored in the data memory 3o.

The data processor 3q for sound spectrum can produce the group of pcm data codes indicative of frequency spectrum for original vibrations and the set of pcm data codes indicative of frequency specular for resonant vibrations as described hereinbefore. The data processor 3q is further operative to cause the frequency specular to decay.

In detail, when a player releases a key of a piano, original vibrations on a string rapidly decays, because an associated damper mechanism 1i returns to contact with the vibrating string. The data processor 3q simulates the decay, and sequentially decreases the values of the pcm data codes. The resonant tones continue for several seconds in so far as the player keeps the damper pedal 1f' in the depressed state. However, if the player releases the damper pedal 1f', the resonant tones are rapidly decayed. The data processor 3q further simulates these decay, and sequentially decreases the values of the pcm data codes for the resonant vibrations.

The decay is not constant. If the player releases the damper pedal through a half pedal, the tones decay at lower speed rather than the ordinary release. Moreover, some players use the half pedal in such a manner as to retard low-pitched tones rather than high-pitched tones, and such a pedal manipulation is called as an oblique contact. On the contrary, if the damper pedal causes all the damper mechanisms to be simultaneously brought into contact with the strings 1*d*, the damper manipulation is referred to as simultaneous contact. The data processor 3*q* can simulate the gentle decay upon the release through the half pedal as well as the oblique contact, and the values of the pcm data codes are decreased at either high, standard or low speed in the simultaneous contact and at different speed in the oblique contact. The data processor 3*q* may change the ratio between the fundamental tone and the harmonics thereof for the half pedal and decay high-order harmonics faster than the fundamental tone. The frame of a piano usually vibrates, and the frame noises participate the piano sound. The data processor 3*q* may take these secondary noises into account and modify the frequency ratio.

The audio signal generator 3*u* comprises a digital filter, a digital-to-analog converter and a low-pass filter, and produces an analog audio signal from the pcm data codes supplied from the data memories 3*m* and 3*o* and/or the data processors 3*n*, 3*p* and 3*q*. The pcm data codes are subjected to a digital filtering, and are, then, converted into the analog audio signal. In the digital filtering, the vibration characteristics of the speaker system 3*e* and vibration characteristics of the speaker box 3*f* are taken into account, and the pcm data codes are modified in such a manner that the frequency spectrum of produced sounds becomes flat. The digital filter is of the FIR type in this instance. However, an IIR type digital filter is available. An oversampling type digital filter may follow the digital filtering for eliminating quantized noises.

After the digital filtering, the digital-to-analog converter produces the analog audio signal, and the analog audio signal is filtered by the low-pass filter, and the low-pass filter is of a Butterworth type for improving group delay. The analog audio signal AD thus filtered is supplied through the equalizer 3*v* to the amplifier unit 3*d*, and the amplifier unit 3*d* amplifies the analog audio signal AD for driving the speaker system 3*e* and/or the headphone 3*h*.

The floppy disk driver 3*t* reads out data codes formatted in accordance with the MIDI standards from a floppy disk under the control of the floppy disk controller 3*s*, and the supervisor 3*k* allows the audio signal generator 3*u* to reproduce sounds from the data codes read out from the floppy disk. A music can be reproduced in the timbre of another musical instrument such as, for example, a pipeorgan, a harpsichord or a wind musical instrument.

The supervisor 3*k* may format the detecting signals of the key sensors 3*b* and the detecting signal of the pedal sensor 3*c* in accordance with the MIDI standards, and the MIDI codes are stored in a floppy disk under the control of the floppy disk controller 3*s*. If the keyboard instrument can record and reproduce a performance, the keyboard instrument has the recording mode and the playback mode.

Assuming now that a player wants to perform a music in the silent mode, the player steps on the pedal 2*c*, and the driving sub-mechanism 220 changes the rotary stopper 2*a* to the block position BP. The interlock sub-system 221 transfers the rotation of the rotary stopper 2*a* to the regulator 2*b*, and the regulator 2*b* causes the regulating buttons 1*e* to enter into the close position.

In this situation, the player selectively depresses the black and white keys 1*g*, and the key action mechanisms 1*b* sequentially drive the associated hammer assemblies 1*c* for rotation. The toes are brought into contact with the regulating buttons 1*e* in the close position, and the jacks 105 escape the associated butts 110 earlier than the acoustic sound mode. The key action mechanisms 1*b* and the hammer assemblies 1*c* give the piano key touch to the player at the escape of the jacks 105. Each hammer assembly 1*c* travels over the distance between the escape point and the rotary stopper 2*a*, and rebounds on the rotary stopper 2*a* before striking the associated set of strings 1*d*.

On the other hand, the key sensors 3*b* monitor the associated black and white keys 1*g*, and produce the digital code signals from the motions of the depressed keys. The pedal sensor 3*c* also monitors the damper pedal 1*f'*, and produces the detecting signal. These signals are supplied to the input ports assigned thereto, and the supervisor 3*k* fetches the data represented by the signals for processing the data as described hereinbefore. Finally, the audio signal generator 3*u* produces the audio signal AD, and the audio signal AD is supplied to the speaker system 3*e* and/or the headphone 3*h* through the equalizer 3*v* and the amplifier 3*d*. Thus, the player confirms the performance through the speaker 3*e* or the headphone in small volume, and practices the performance without disturbing neighborhood.

If the player wants to perform a music in the acoustic sound mode, the pedal 2*c* is released from the depressed state, and the link mechanism allows the rotary stopper 2*a* and the regulating buttons 1*e* to concurrently return to the free position and the spaced position. Therefore, the jacks 105 escape from the butts 110 at the standard points, and the hammer heads 112 strike the associated sets of strings 1*d*, thereby producing the acoustic sounds.

The link mechanism 2*d* is economical rather than electric motors respectively coupled to the rotary stopper 2*a* and the rod member 201, and is suitable for a low or middle grade piano.

As will be understood from the foregoing description, the link mechanism 2*d* concurrently changes the rotary stopper 2*a* and the regulating buttons between the silent mode and the acoustic sound mode, and a player can practice a fingering in the unique piano key touch at all times.

Second Embodiment

Figure 6:
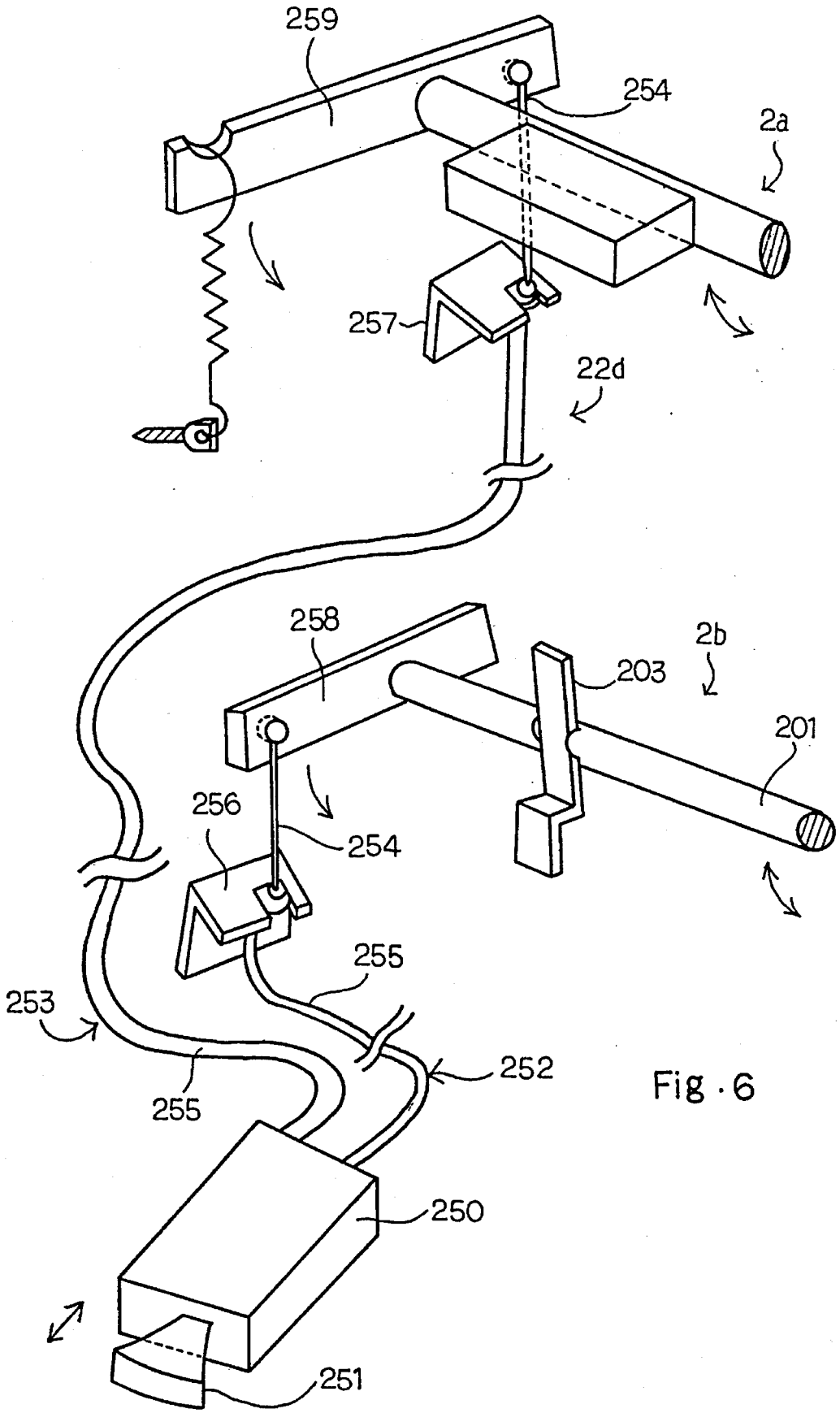
FIG. 6 is a perspective view showing a link mechanism incorporated in another keyboard musical instrument according to the present invention.
Figure 7:
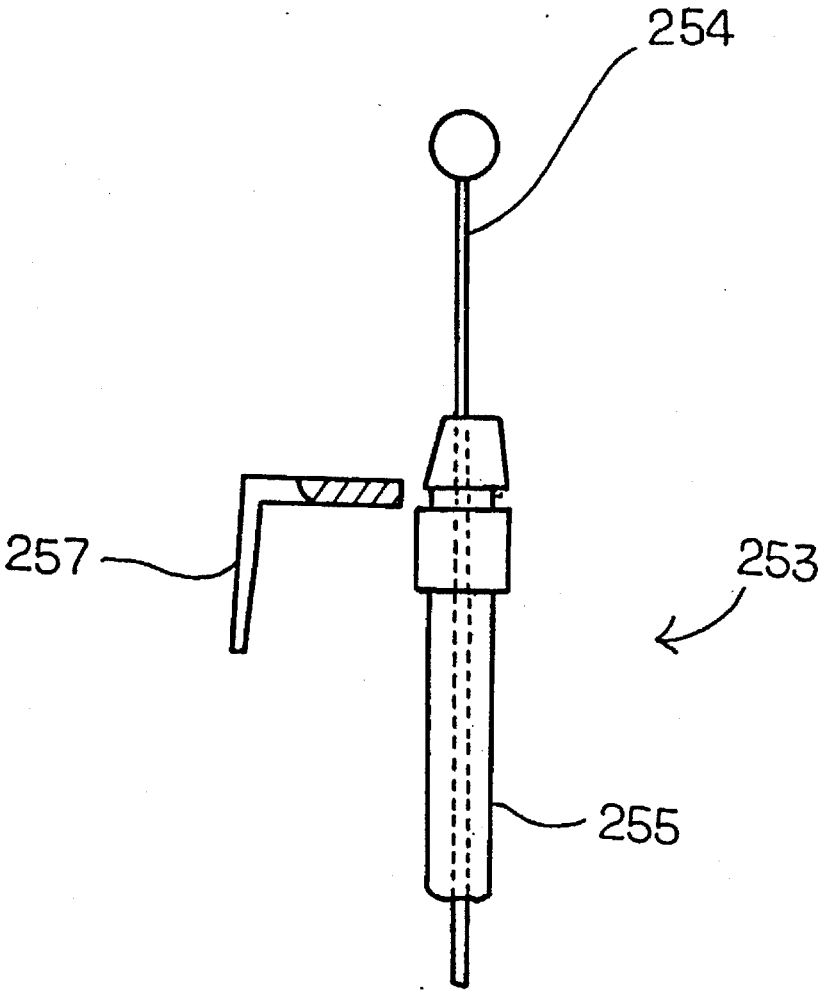
FIG. 7 is a front view showing a flexible cord incorporated in the link mechanism.

Turning to FIGS. 6 and 7 of the drawings, a link mechanism 22*d* incorporated in another keyboard musical instrument is provided for a rotary stopper 2*a* and a regulator 2*c*. The other components of the keyboard musical instrument are similar to those of the first embodiment, and no further description is made on the other components.

The link mechanism 22*d* comprises a box 250 attached to a suitable board member of an acoustic piano such as, for example, a lower surface of the key bed, a grip 251 slidable in the box 250, two flexible cords 252 and 253 each implemented by a flexible line 254 slidably inserted into a flexible tube member 255, stationary bracket members 256 and 257 engaged with the flexible tubes 255 and arm members 258 and 259 fixed to the leading ends of the flexible lines 254. The other ends of the flexible lines 254 are connected to the grip 251.

When a player pulls the grip 251, the flexible lines 254 concurrently rotate the arm members 258 and 259 and, accordingly, the rotary stopper 2*a* and the rod member 201, thereby causing the rotary stopper 2*a* and the regulating buttons 1*e* to enter into the blocking position and the close position. On the other hand, when the player pushes the grip 251, the flexible lines 254 rotate the arm members 258 and 259 in the opposite direction, and the rotary stopper 2*a* and the regulating buttons 1*e* return to the free position and the spaced position, respectively.

The link mechanism 22*d* achieves all the advantages of the first embodiment.

Although particular embodiments of the present invention have been shown and described, it will be obvious to those skilled in the art that various changes and modifications may be made without departing from the spirit and scope of the present invention. For example, a sprockets and a chain or a belt may form the link mechanism, and a gear train is also available. Moreover, the link mechanism may be replaced with a combination of an electric motor/solenoid-operated actuator and a link mechanism insofar as the switching unit for the motor/actuator is linked with the link mechanism.

What is claimed is:

1. A keyboard musical instrument having at least an acoustic sound mode for producing acoustic sounds and an electronic sound mode for producing electronic sounds, comprising:

an acoustic piano having:

a keyboard including a plurality of swingable keys for being depressed by a player in both the acoustic sound and electronic sound modes;

a plurality of hammer assemblies;

a plurality of key action mechanisms wherein:

each of said key action mechanisms is connected to a respective one of said plurality of swingable keys and a respective one of said pluralities of hammer assemblies;

each of said key action mechanisms drives the respective connected hammer assembly in response to the connected respective one of said plurality of swingable keys being depressed, thereby producing a piano touch in both the acoustic sound and electronic sound modes; and each of said key action mechanisms has a home position and an escape position;

a plurality of regulating buttons, wherein each respective one of said regulating buttons is spaced apart from a respective one of said plurality of key action mechanisms when the respective key action mechanism is in said home position and wherein each respective one of said regulating buttons contacts a respective one of said plurality of key action mechanisms when the respective key action mechanism is in said escape position; and a plurality of string members associated with said hammer assemblies, respectively, wherein said hammer assemblies strike said string members in said acoustic sound mode;

an electronic sound generating system for producing said electronic sounds in response to the keys being depressed in said electronic sound mode; and a mode controlling system having:

a stopper positioned between said plurality of hammer assemblies and said plurality of string sets, and being positioned in a free position allowing said hammer assemblies to strike the string members in said acoustic sound mode and a blocking position wherein said stopper blocks the hammer assemblies from striking said string members in said electronic sound mode by causing said hammer assemblies to return to the home position from a location between said escape position and the position at which said hammer assemblies strike the respective string members;

a regulator connected to said plurality of regulating buttons, and changing distances between said plurality of key action mechanisms and said plurality of regulating buttons between said acoustic sound mode and said electronic sound mode for allowing said plurality of key action mechanisms to escape in both acoustic sound and electronic sound modes; and a link mechanism connected between said stopper and said regulator, for causing said stopper and said regulator to change the position between said free position and said blocking position and said distances between said plurality of key action mechanisms and said plurality of regulating buttons, respectively.

2. The keyboard musical instrument as set forth in claim 1 further comprising a manipulating member, wherein said link mechanism includes:

a driving link sub-mechanism connected between the manipulating member and said stopper for changing said stopper between said free position and said blocking position, and an interlock sub-mechanism connected between said stopper and said regulator and transferring a motion of said stopper to said regulator for changing the distances between the regulating buttons and the key action mechanisms.

3. The keyboard musical instrument as set forth in claim 2, wherein:

said stopper includes a bearing unit wherein the stopper is rotatably mounted by the bearing unit within said piano;

said regulator has a rotational rod member connected through said interlock sub-mechanism; and said interlock sub-mechanism includes an adjuster for regulating said distances when said stopper is in said free position.

4. The keyboard musical instrument as set forth in claim 1, in which said link mechanism comprises:

a manipulating member manipulated by said player, a plurality of flexible cords each having a first end and a second end, wherein each of said flexible cords is connected at the first end thereof to said manipulating member and at the second end thereof to said stopper and said regulator, and a flexible tube through which each flexible cord is slidably inserted.

5. A keyboard musical instrument having at least an acoustic sound mode for producing acoustic sounds and an electronic sound mode for producing electronic sounds, comprising:

an acoustic piano comprising:

a keyboard including a plurality of swingable keys for being depressed by a player in both the acoustic sound and electronic sound modes;

a plurality of hammer assemblies;

a plurality of key action means for functionally connecting each of said hammer assemblies to a respective one of said keys and for selectively driving said hammer assemblies in response to said respective one of said keys being depressed thereby producing a piano-touch in both the acoustic sound and electronic sound modes, each said key action means having a home position and an escape position;

regulating means associated with each of the key action means, for regulating distances between the home positions and the escape positions;

a plurality of string members associated with said hammer assemblies, respectively, said hammer assemblies for striking said string members, respectively, in said acoustic sound mode;

electronic sound generating means for producing said electronic sounds in response to the keys being depressed in said electronic sound mode; and a mode controlling means for selecting between the acoustic sound and electronic sound modes having:

a stopper positioned in a free position for permitting the hammer assemblies to strike the string members in said acoustic sound mode and positioned in a blocking position for blocking the hammer assemblies from striking the string members in said electronic sound mode by causing said hammer assemblies to return to the home position from a location between said escape position and said hammer assemblies striking the string members;

a regulator for changing the distances between said home positions and said escape positions by altering distances between the regulating means and the key action means for allowing the key action means to escape from the hammer assemblies in both the acoustic sound and the electronic sound modes; and a link mechanism connected between the stopper and the regulator for concurrently causing the stoppers to change position between the free position and the blocking position and the regulator to change the distances between the regulator means and the key action means upon selection of said acoustic sound or electronic sound modes.

6. The keyboard musical instrument as set forth in claim 5, said link mechanism of said mode controlling means further comprising:

a driving link sub-mechanism connected to a manipulating member and said stopper for changing said stopper between the free position and the blocking position; and an interlock sub-mechanism connected between said stopper and said regulator for transferring a motion of said stopper to the regulator for changing the distances between the regulator means and the key action means.

7. The keyboard musical instrument as set forth in claim 5, said link mechanism of said mode controlling means further comprising:

a manipulating member for manipulation by a player and a plurality of flexible cords, each connected at one end with the manipulating member and at an opposite end with the stopper and regulator.

* * * * *